United States Patent [19]

Sarna et al.

[11] 4,314,625

[45] Feb. 9, 1982

[54] ARTIST'S PORTFOLIO

[75] Inventors: Abraham Sarna, Woodford; David Sarna, London, both of England

[73] Assignee: A. Sarna & Son Limited, London, England

[21] Appl. No.: 134,413

[22] Filed: Mar. 27, 1980

[30] Foreign Application Priority Data

Oct. 29, 1979 [GB] United Kingdom ..... 37455/79

[51] Int. Cl.[3] ..... A45C 11/00

[52] U.S. Cl. ..... 190/16

[58] Field of Search ..... 190/16; 281/33; 248/460, 461

[56] References Cited

U.S. PATENT DOCUMENTS

| | | | |
|---|---|---|---|
| 1,086,746 | 2/1914 | Babbitt | 190/16 |
| 1,614,977 | 1/1927 | Ausmus | 281/33 |
| 3,311,202 | 3/1967 | Schell | 190/16 |

*Primary Examiner*—Donald F. Norton

*Attorney, Agent, or Firm*—Emory L. Groff, Jr.

[57] ABSTRACT

This invention relates to an improved artists' portfolio, for the purpose of retaining and transporting sheet material such as prints or photographs, in a manner affording protection during carriage but enabling the contents to be displayed individually when required. The portfolio generally has two covers 1 and 2 joined at 3 which may be brought into juxtaposition and secured by a slide fastener 5 and flap 6 having a catch 7. The cover 1 includes a spine 10 joined with a support board 12 having a tongue X which may be positioned to engage beneath a handle 9 so as to form an "easel" structure. Transparent folders are secured to the spine 10 by rings 15. In this construction both sides of the transparent folders may be displayed by either lying on support 12 or cover 1 and the support 12 is made into a rigid structure by engagement beneath the handle. Further the folders depend from the rings when in a normal position of carriage ensuring the contents are always flat in a suspended state.

2 Claims, 3 Drawing Figures

ARTIST'S PORTFOLIO

BACKGROUND OF INVENTION

This invention relates to an improved artists' portfolio, for the purpose of retaining and transporting sheet material such as prints or photographs, in a manner affording protection during carriage but enabling the contents to be displayed individually when required. It is an object of this invention to provide a portfolio which is a further improvement on that described in our patent application Ser. No. 15,342 filed Feb. 26, 1979 and now U.S. Pat. No. 4,213,520 in which the sheet material is fully protected when closed and which may be opened and erected to form an easel-like structure in a simple manner, and which enables both sides of the sheet material to be displayed over the easel-like structure formed from the portfolio parts. The primary object of this invention is to provide a portfolio which is more rigid when erected and which can be transported in the erected state.

SUMMARY OF INVENTION

According to this invention there is provided an artists' portfolio comprising two outer covers with one side of each cover joined so as to open and close book-fashion to form a case, closure means to secure the two adjacent free sides of each cover, a flap with a carrying handle being provided on the free side of one cover opposite the side thereof joined to the other cover, the side of the said other cover opposite to the side thereof joined to the one cover including a spine with securing means for sheet material and a support with a tongue on a side thereof which may be swung from a position lying between the covers when the case is closed to a position in which the tongue on the side of the support engages under the handle on the flap when the flap is positioned to lie generally over the one cover opposite to the side thereof joined to the other cover, whereby a triangular structure is formed with the sheet material to lie against either the flat support or the other cover.

Preferably the free side of the support includes lugs on which the bottom of the sheet material may bear to relieve weight from the spine.

The spine preferably comprises a rigid portion flexurally joined along respective sides to the support, which may be a flat board, and the cover. The spine preferably has a ring-like securing means to hold sheet material and preferably a plurality of transparent folders. The arrangement provides for the sheet material to be displayed in a manner affording ready viewing and each sheet may be succesively turned over to display the next. The reverse side of a sheet may be displayed on the other side of the triangular structure, the spine preferably being arranged to allow the sheets to lie flat in either position of display.

The closure means of the free sides of the covers adjacent the joined sides preferably comprises a slide fastener means but may be simply an overlap of material to protect the contents.

The invention is described and illustrated by the accompanying drawings showing two embodiments as examples. In the drawings:

DESCRIPTION OF PREFERRED EMBODIMENTS

Figure 1:
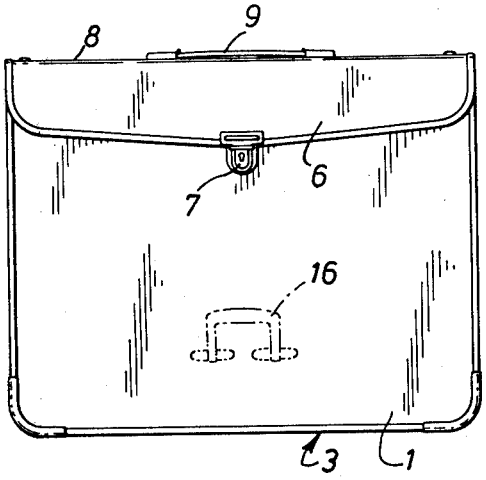
FIG. 1 is a face view of our known construction of portfolio closed.
Figure 2:
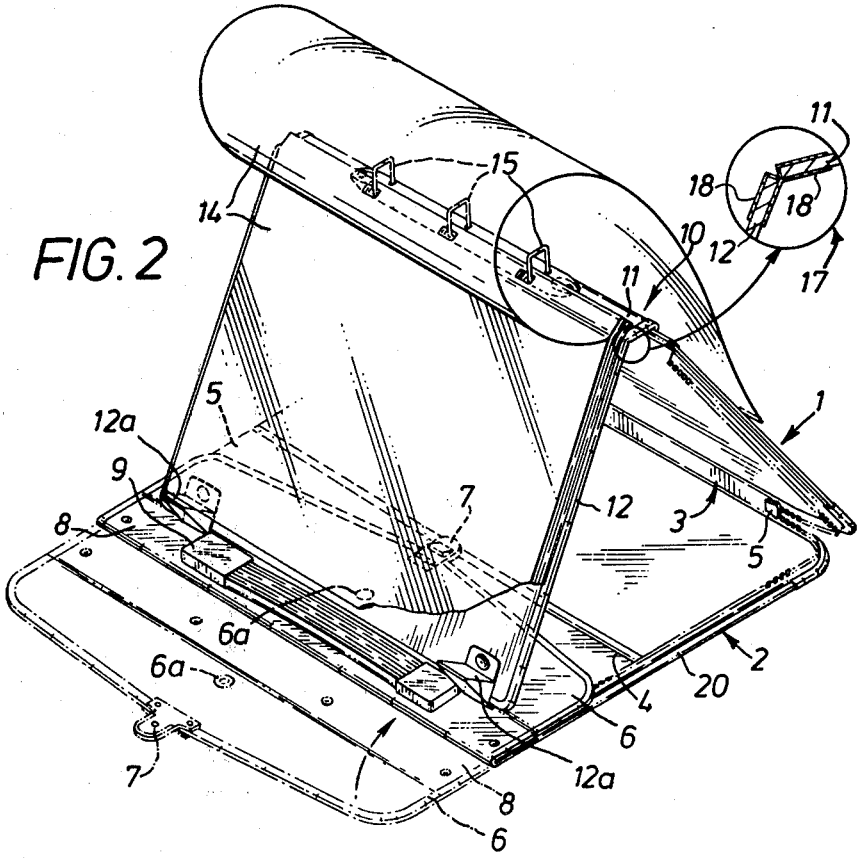
FIG. 2 shows, in perspective, one embodiment of the portfolio of FIG. 1 opened up for display of the contents.

Referring to the drawings, the known portfolio of our patent application Ser. No. 15,342 comprises a first outer cover 1 and a second outer cover 2 joined at 3 so as to open and close in book fashion. The covers may be formed from rigid board with a covering of plastics material such as leather or cloth, and the joint may be of leather or cloth with appropriate connections to the respective covers. The second cover has a pocket 4 on the inside surface. The covers may be brought together and closed by means of slide fasteners 5 along opposed adjacent sides. A flap 6 formed as an extension of the cover 2 and foldable over the cover 1 is secured by a lockable fastening catch 7. The flap 6 has a spine portion 8 with a handle 9 secured thereon.

The side of cover 1 opposite to the joint 3 has a spine 10 comprising a rigid strip 11 flexibly joined to the cover 1 and to a support board 12 by respective sides. The board 12 may be covered with leather or cloth and the free side of the support opposite spine 10 bears against the handle 9 at a position near the side of cover 2. In this way a triangular "easel" like structure is formed and transparent folders 14 secured to spine 10 by rings 15 lie either against the support 12 or, by turning same over, against the cover 1. One folder is shown during the turning over and in the final position will lie adjacent cover 1.

In the closed position the support 12 is moved to overlie cover 1 which then is closed upon cover 2 after opening out the flap 6, whereby support 12 and folders 14 are protected between the covers which are then secured together by fasteners 5 and flap 6 retained by lock 7.

The spine 10 is adjacent the handle 9 and thus in normal carriage the sheet material remains towards the base of the folders.

Portions of the structure may include metal reinforcement as necessary (for example in the spines 8 and 10). When closed the spine 10 lies flat against cover 1 in the plane of the support 12, with the rings 15 abutting the cover 2 and providing spacing between the covers at that end near flap 6.

For larger sizes of portfolio, such as for A1 size sheets, it is convenient to provide a handle 16 for carrying at a position towards the bottom of side 1. This enables the case to be carried partly beneath the arms.

The material forming board 12 and spine strip 11 will preferably be thick with squared-off abutting edges joined by two pieces of adhesive tape material 18 as illustrated in the detail 17. This construction allows the two parts to hinge in one direction only so that with a weight of folders 14 the parts become coplanar and the spine does not tend to "sink". With folders against side 1 the spine part tends to become coplanar with this side as the joint freely hinges in the direction allowing this.

The flap 6 is effectively an integral extension of side 2 and is arranged to fold to lie over this side as shown in full lines. In such position the handle assembly 9 forms an abutment for the edge of board 12. The flap is retained in this position by means of a press stud fastener 6*a* which secures flap 6 to side 2.

Figure 3:
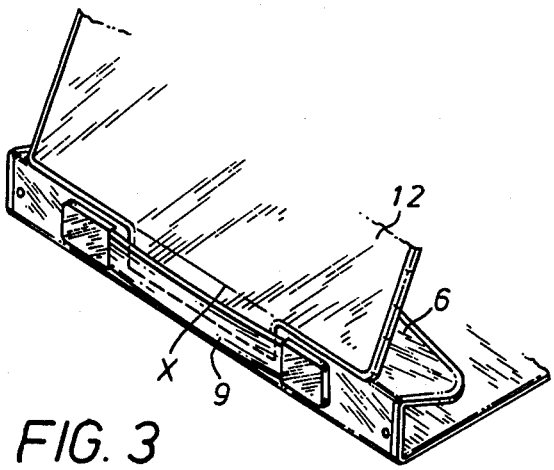
FIG. 3 shows, in perspective and in part only an embodiment including the improvement of the present invention.

As shown in FIG. 3 the improvement has the support board 12 formed with an integral tongue X which can be inserted under the handle 9 when the flap is appropriately positioned. This makes the structure more rigid and enables the whole display to be moved when open and erect without collapse. In this embodiment the spine part of flap 6 carrying the handle 9 is aligned into coplanar relationship with the support 12 to allow insertion of the tongue. The arrangement is otherwise similar to that previously described.

We claim:

1. An artists' portfolio comprising two outer covers with one side of each cover joined so as to open and close book-fashion to form a case, closure means to secure the two adjacent free sides of each cover, a flap with a carrying handle being provided on the free side of one cover opposite the side thereof joined to the other cover, the side of the said other cover opposite to the side thereof joined to the one cover including a spine with securing means for sheet material and a support with a tongue on a side thereof which may be swung from a position lying between the covers when the case is closed to a position in which the tongue on the side of the support engages under the handle on the flap when the flap is positioned to lie generally over the one cover opposite to the side thereof joined to the other cover, whereby a triangular structure is formed with the sheet material to lie against either the flat support or the other cover.

2. An artists' portfolio as claimed in claim 1, wherein the closure means to secure the two adjacent free sides of the covers comprises the flap on one cover with fastening means engageable with fastening means provided on the other cover.

* * * * *